US007661644B1

(12) United States Patent
Yen

(10) Patent No.: US 7,661,644 B1
(45) Date of Patent: Feb. 16, 2010

(54) CARRY BAG WITH EDGE SWING

(76) Inventor: Elton Yen, 13460 Brooks Dr., Baldwin Park, CA (US) 91706

( * ) Notice: Subject to any disclaimer, the term of this patent is extended or adjusted under 35 U.S.C. 154(b) by 0 days.

(21) Appl. No.: 12/229,177

(22) Filed: Aug. 19, 2008

(51) Int. Cl.
*F16B 45/00* (2006.01)

(52) U.S. Cl. ..... 248/304; 248/914; 223/120

(58) Field of Classification Search ..... 248/914, 248/683, 205.6, 304; 223/120
See application file for complete search history.

(56) References Cited

U.S. PATENT DOCUMENTS 3,289,985 A * 12/1966 Sheiman ..... 248/95
2008/0042032 A1* 2/2008 Yap et al. ..... 248/304

* cited by examiner

*Primary Examiner*—Amy J Sterling
(74) *Attorney, Agent, or Firm*—Raymond Y. Chan; David and Raymond Patent Firm

(57) ABSTRACT

An edge swing, adapted for hanging a carry bag below a table, includes a retention body for being rested on a top surface of the table, and an supporting arm having a pivot end rotatably coupling with the retention body and a hooking end downwardly extended from the retention body, wherein the supporting arm is adapted to fold between a storage position and a hanging position. At the storage position, the supporting arm is folded to encircle the peripheral edge of the retention body, so as to minimize an overall size of edge swing and to use as a decoration. At the hanging position, the supporting arm is extended at a position that the hooking end of the supporting arm is downwardly extended below a bottom surface of the table for hanging the carrying bag underneath the table.

16 Claims, 6 Drawing Sheets

CARRY BAG WITH EDGE SWING

BACKGROUND OF THE PRESENT INVENTION

1. Field of Invention

The present invention relates to a bag holder, and more particularly to an edge swing for carry bag, wherein the edge swing is adapted for hanging a personal carry bag underneath the table and for being folded into a compact size for carry and storage.

2. Description of Related Arts

Most of people are annoyed with where to put the personal belongings at the public places. For instance, a lady usually has to put her purse on her lap at the restaurant, which is considered as the most safety way to prevent the purse from being stolen. However, not only is it uncomfortable but also an improper table manner for the lady to put her purse between the table and herself. Alternatively, the lady may put the purse on the floor or hang it at the back of the chair. However, the purse will be dirty and has germs on it, or be kicked when the purse is on the floor; when the purse is hung out at the back of the chair, the purse is out of her observation and is easily to be stolen. Another example is a student studying in the library, usually put their carrying bag on the desktop. Therefore, the surface area of the desk is really limited for other stuff such as books and laptop.

A conventional desk hanger is adapted to solve the above problems to hang the personal items at the table edge. One of the conventional hangers is built-in with the table. However, the table set up at the restaurant may not be incorporated with the built-in type hanger. Another type of table hanger can be detachably coupled with the table surface to hang the personal item. This hanger is relatively large or not easy to fold it, so that the user may be not willing to carry the hanger everywhere.

Therefore, the conventional hangers do not meet the demands of the customer needs. It increases not only in its compact size but also in its easy way to fold and unfold. Furthermore, to make the portable edge swing as a decoration can increase the willing of the user to take the hanger with the user all the time.

SUMMARY OF THE PRESENT INVENTION

A main object of the present invention is to provide an edge swing for the carry bag, wherein the edge swing is adapted for hanging carry bag under the table. and for folded into a compact size for carrying and storage.

Another object of the present invention is to provide an edge swing for the carry bag, wherein the edge swing comprises a supporting arm adapted to fold and unfold easily and to minimize an overall size of the edge swing to a compact size at a storage position.

Still another object of the present invention is to provide an edge swing for the carry bag, wherein the edge swing comprises a carrying element for being detachably carried by the carry bag so that the edge swing, as a portable device, can be hanged on the bag as a decoration as well.

Another object of the present invention is to provide an edge swing for the carry bag, wherein the structure of the hanger is simple to manufacture.

Another object of the present invention is to provide an edge swing for carry bag, wherein the edge swing can be moved further into the edge of the table to enhance the stabilization of the carry bag via the edge swing at the table.

According to the above objects, the present invention provides an edge swing for hanging a personal item underneath a table or like, wherein the edge swing comprises a retention body for being rested on a top surface of the table, and a supporting arm extended from the retention body.

The supporting arm has an upper pivot end pivotally coupling with the peripheral edge of the retention body and a lower hooking end downwardly extended from the retention body, wherein the supporting arm is adapted to fold between a storage position and a hanging position. At the storage position, the supporting arm encircles the peripheral edge of the retention body of the edge swing to minimize an overall size of the personal edge swing. At the hanging position, the supporting arm is extended at a position that the hooking end of the supporting arm is downwardly extended below a bottom surface of the table for hanging the personal carry bag underneath the table.

The edge swing further comprises a strain coupling with the pivot end of the supporting arm, so that the storage position of the hanger can be used as an adornment hanged on the carry bag.

These and other objectives, features, and advantages of the present invention will become apparent from the following detailed description, the accompanying drawings, and the appended claims.

DETAILED DESCRIPTION OF THE PREFERRED EMBODIMENT

Figure 1:
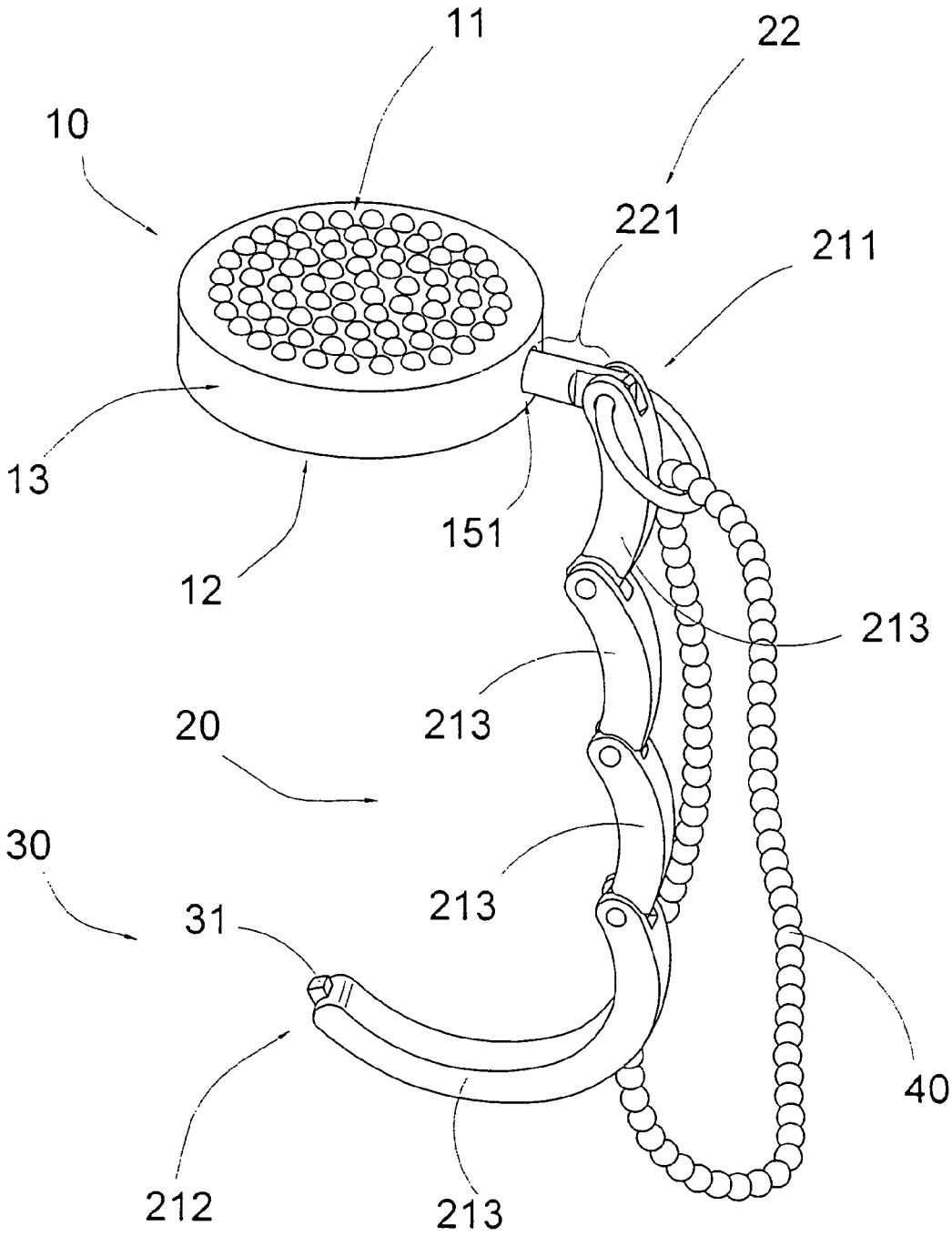
FIG. 1 is a perspective view of an edge swing for the carrying bag at a hanging position according to a preferred embodiment of the present invention, illustrating the supporting arm downwardly extended from the peripheral edge of the retention body.
Figure 2:
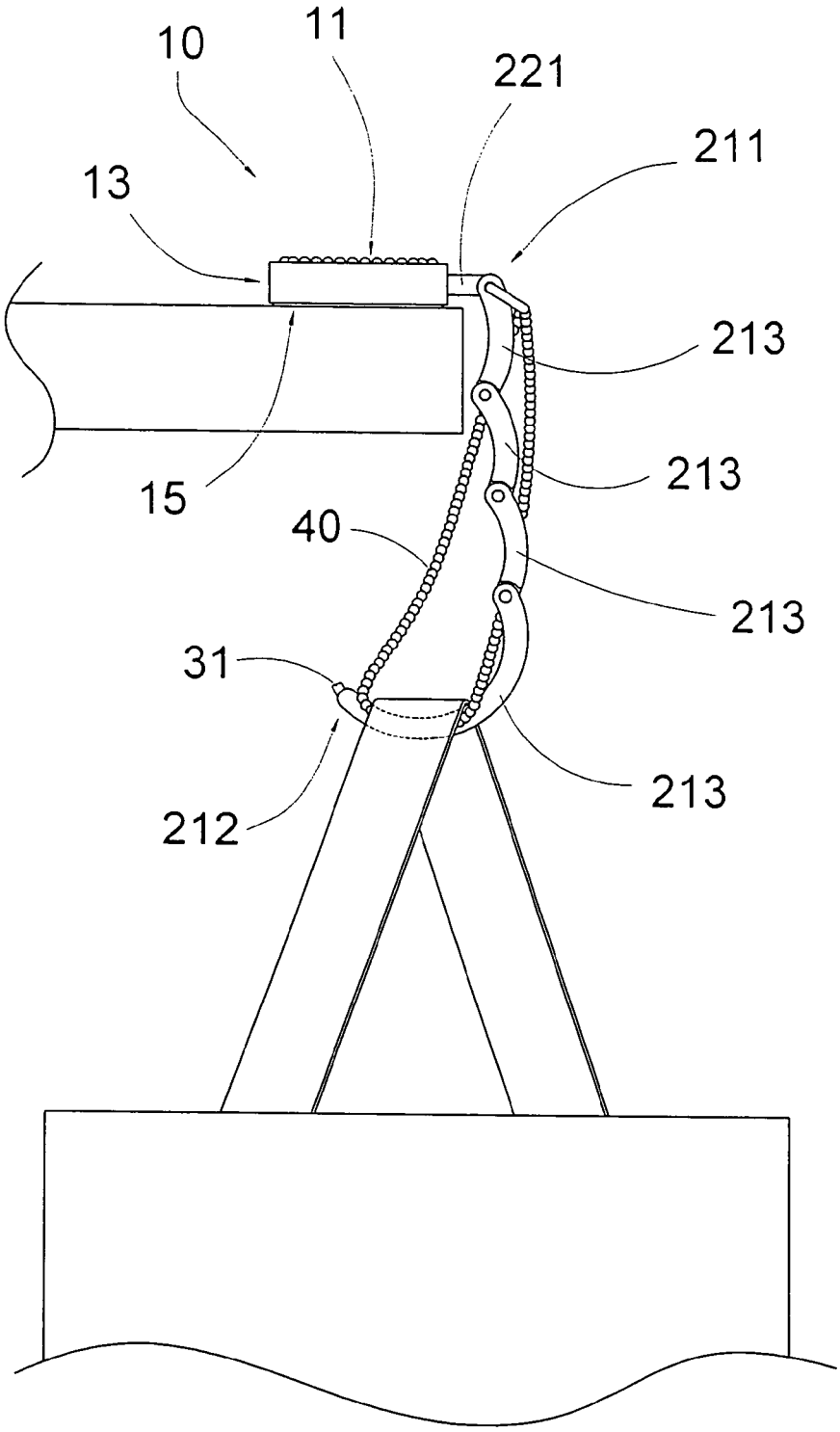
FIG. 2 is a side view of the edge swing according to the above preferred embodiment of the present invention, illustrating the carrying bay being suspendedly supported underneath the table via the edge swing.

Referring to FIG. 1 of the drawing, an edge swing for carrying bag according to a preferred embodiment of the present invention is illustrated, wherein the edge swing is adapted for hanging a personal carrying bag below a table or the like such as a desk as shown in FIG. 2. Accordingly, the edge swing of the present invention comprises a retention body 10 adapted for being rested on a top surface of the table at a position close to an edge thereof, and a hanger unit 10 coupling with the retention body 10.

As shown in FIG. 2, the retention body 10, which is adapted for being rested on a top surface of the table at a position close to an edge thereof, has a top side 11, a bottom side 12, and a peripheral edge 13 defining between the top side 11 and the bottom side 12. The retention body 10 further has a cavity 14 provided between the top side 11 and the bottom side 12 within the peripheral edge 13 such that the peripheral edge 103 is formed as a surrounding wall of the cavity 14.

Figure 3:
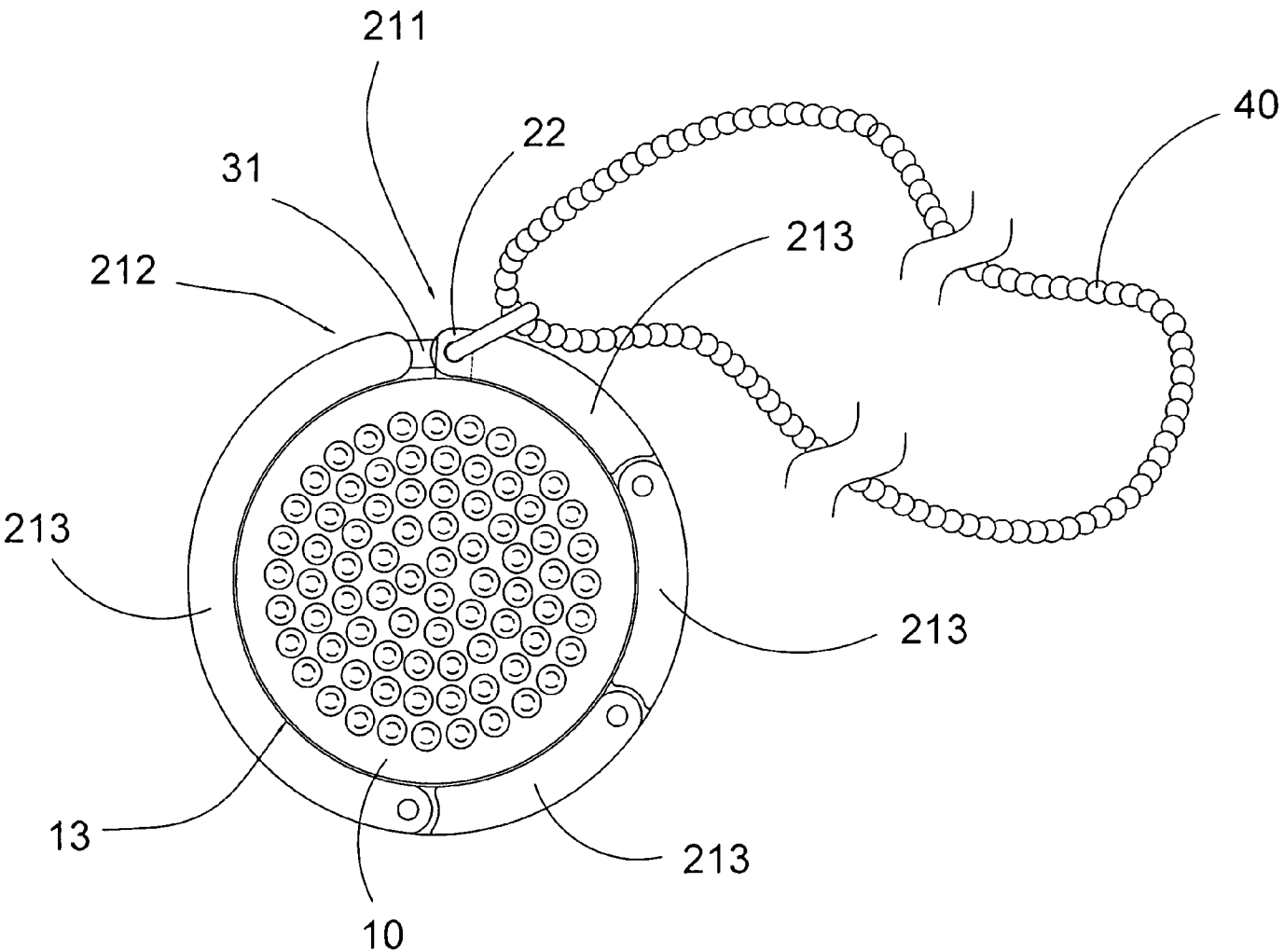
FIG. 3 is a top view of the edge swing at the storage position according to the above preferred embodiment of the present invention, illustrating the supporting arm encircling with the retention body.

The hanger unit 20 comprises a supporting arm 21 extended from the retention body 10 and adapted to fold between a storage position and a hanging position. The supporting arm 21 has a pivot end 211 pivotally coupling with the peripheral edge 13 of the retention body and a hooking end 212 adapted for the carrying bag being hanged thereat. Accordingly, at the storage position, as shown in FIG. 3, the supporting arm 21 is folded to encircle around the peripheral edge 13 of the retention body 10. At the hanging position, as shown in FIG. 2, the hooking end 212 of the supporting arm 21 is downwardly extended below the table along the edge thereof for suspendedly supporting the carrying bag underneath the table.

According to the preferred embodiment, the retention body 10 has a circular cross section for evenly distributing the downward supporting force of the carrying bag, i.e. the weight of the carrying bag, via the hanger unit 20 when the retention body 10 is rested on the table. The top side 11 of the retention body 10 has a decorative surface as the top decorative side while the bottom side 12 of the retention body 10 has a friction surface as the bottom friction side. A friction layer 15 is overlapped on the bottom side 12 of the retention body 10 to form the bottom friction side thereof to prevent an unwanted movement of the retention body 10 on the top surface of the table especially when the carry body is suspendedly supported by the retention body 10 via the supporting arm 21. Therefore, when the retention body 10 is rested on the top surface of the table, the bottom side 12 of the retention body 10 is frictionally engaged with the top surface of the table to enhance the stabilization of the retention body 10 while the top side 11 of the retention body 10 is facing upward for enhancing the aesthetic appearance of the retention body 10.

As shown in FIGS. 1 and 2, the supporting arm 21 comprises a plurality extension units 213 pivotally coupling with each other end-to-end, wherein the pivot end 211 of the supporting arm 21 is defined at a free end of one of the extension units 213 to pivotally couple with the retention body 10 while the hooking end 212 of the supporting arm 21 is defined at another free end of the respective extension unit 213. Preferably, there are four extension units 213 pivotally coupling with each other to form the supporting arm 20.

Accordingly, each of the extension units 213 has an inner surface having a curvature matching with the peripheral curvature of the retention body 10 in such a manner that the extension units 21 are pivotally folded to encircle the peripheral edge 13 of the retention body 10 a the storage position. In other words, each of the extension units 213 forms an arc sector to align with the peripheral edge 13 of the retention body 10.

As shown in FIGS. 1 and 3, every two adjacent extension units 213 are pivotally coupled with each other end-to-end via a pivot hinge, wherein each of the pivot hinges will limit the pivotally folding angles of the extension units 213 between the storage position and the hanging position.

The supporting arm 21 further has a predetermined length corresponding to a circumferential size of the retention body 10 to downwardly extend below the table for supporting the carrying bag thereat. In addition, when the supporting arm 21 is folded to encircle the peripheral edge 13 of the retention body 10 at the storage position, the hooking end 212 of the supporting arm 21 is coupled with the pivot end 211 thereof to form a loop structure. In other words, the supporting arm 21 forms an outer rim to encircle the retention body 10 at the storage position so as to minimize the overall size of the edge swing and to enhance the aesthetic appearance thereof.

The hanger unit 20 further comprises a sliding shaft 22 slidably and rotatably extended from the peripheral edge 13 of the retention body 10 to pivotally couple with the pivot end 211 of the supporting arm 21, wherein the sliding shaft 22 has a free end pivotally couple with the pivot end 211 of the supporting arm 21 to selectively adjust a distance between the peripheral edge 13 of the retention body 10 and the pivot end 211 of the supporting arm 21.

Accordingly, the sliding shaft 22 is slid between the storage position that the sliding shaft 22 is slid inwardly to move the pivot end 211 towards the peripheral edge 13 of the retention body 10, and the hanging position that the sliding shaft 22 is slid outwardly to move the pivot end 211 of the supporting arm away from the peripheral edge 13 of the retention body 10. Therefore, by slidably and radially pulling out the sliding shaft 22, the distance between the pivot end 211 of the supporting arm 21 is substantially increased to enhance the supportability of the edge swing of the present invention. In other words, the sliding shaft 22 rotatably and slidably couples with the pivot end 211 with the supporting arm 21, so that it can adjust the distance from the peripheral edge 13 of the retention body 10 to the pivot end 211 of the supporting arm 21. As the sliding shaft 22 is extendable, the retention body 10 of the edge swing can be moved further into the edge of the table to have more stable hanging system.

As shown in FIGS. 1 and 3, the edge swing further comprises a magnetic interlocker 30 provided at the hooking end 212 of the supporting arm 21 to magnetically engage with the pivot end 211 of thereof so as to interlock the supporting arm 21 end-to-end at the storage position in a loop structure.

According to the preferred embodiment, the magnetic interlocker 30 comprises a magnetic element 31 protruded at the hooking end 212 of the supporting arm 21, such that when the supporting arm 21 is folded to encircle the peripheral edge 13 of the retention body 10, the hooking end 212 and the pivot end 211 of the supporting arm 21 are coupled with each other to retain the supporting arm 21 at said storage position in a loop structure. The free end of the sliding shaft 22 is made of magnetic attracting material to magnetically couple with the magnetic element 31 so as to interlock the supporting arm 21 end-to-end at the storage position. It is worth to mention that the supporting arm 21 is constructed by the extension units 213 pivotally coupling with each other. Therefore, the magnetic interlocker 30 can securely lock up the extension units 213 of the supporting arm 21 by engaging the hooking end 212 with the pivot end 211. If the magnetic interlocker 30 is provided between the hooking end 212 of the supporting arm 21 and the pivot end 211 thereof, some of the extension units 213 may not adapted to be securely held in position to encircle the peripheral edge 13 of the retention body 10 at the storage position.

It is appreciated that the magnetic element 31 can be provided at the pivot end 211 of the supporting arm 21 to magnetically couple with the hooking end 212 of the supporting arm 21 when the supporting arm 21 is encircled with the retention body 10 at the storage position.

Figure 6:
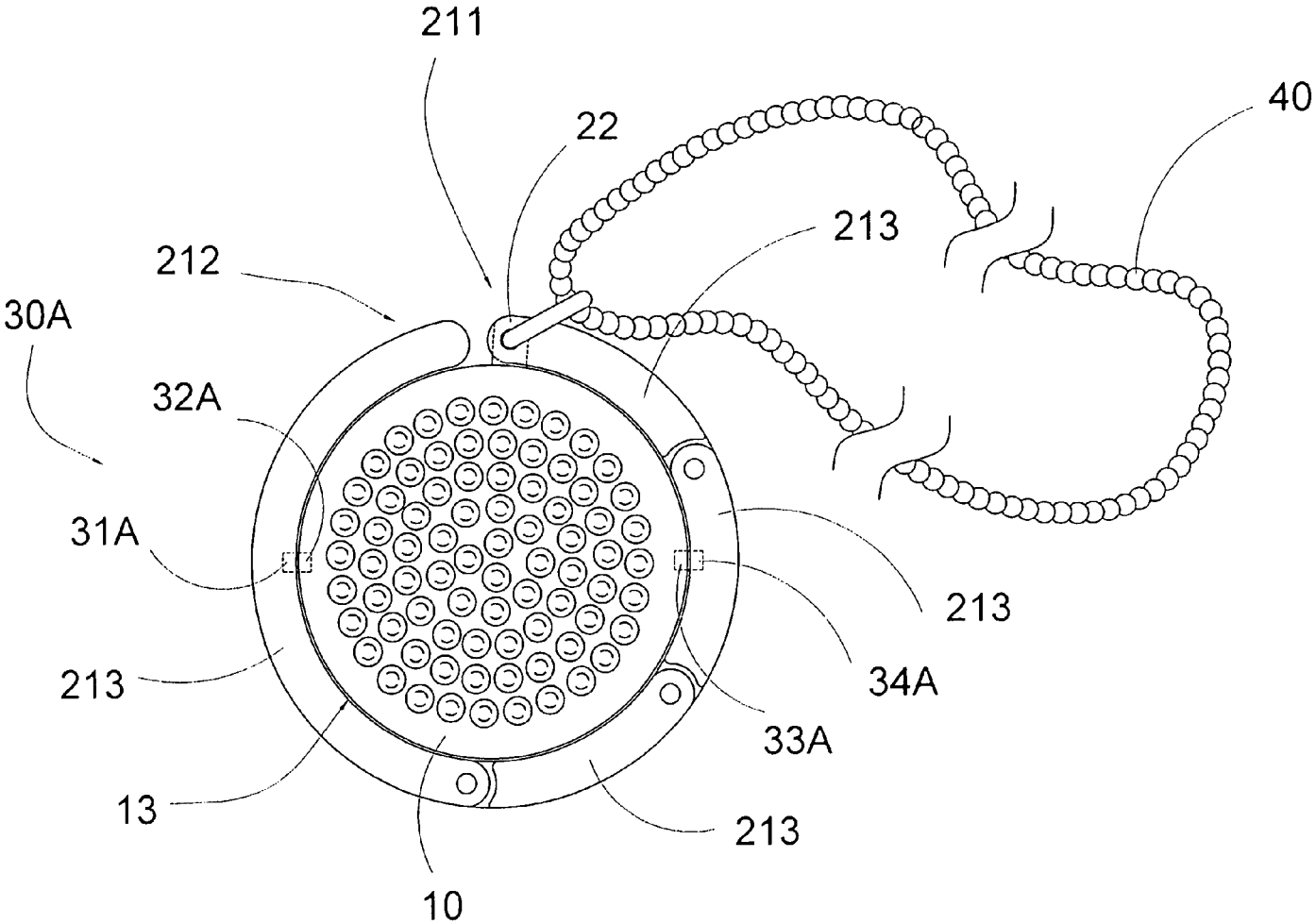
FIG. 6 illustrates an alternative mode of the magnetic interlocker of the edge swing according to the above preferred embodiment of the present invention.

FIG. 6 illustrates an alternative mode of the magnetic interlocker 30A according to the preferred embodiment of the present invention. As shown in FIG. 6, the magnetic interlocker 30A comprises a first magnetic element 31A embedded at the inner surface of the supporting arm 20 at a position close to the hooking end 212 and a second magnetic 32A element embedded at the peripheral edge 13 of the retention body 10 such that when the supporting arm 20 is folded to encircle the peripheral edge 13 of the retention body 10, the second magnetic element 32A is magnetically engaged with the first magnetic element 31A to retain the supporting arm 20 end-to-end in a loop structure. Accordingly, the first magnetic element 31A is provided at the inner surface of the last extension unit 213 where the hooking end 212 is defined thereat while the second magnetic element 32A is provided at the peripheral edge 13 at a position corresponding to the location of the first magnetic element 31A when the supporting arm 20 is encircled around the retention body 10.

The magnetic interlocker 30A further comprises a third magnetic element 33A embedded at the inner surface of the supporting arm 20 at a position close to the pivot end 211 and a fourth magnetic element 34A embedded at the peripheral edge 13 of the retention body 10 at a position opposed to the second magnetic element 32A, such that the supporting arm 20 is folded to encircle the peripheral edge 13 of the retention body 10, the fourth magnetic element 34A is magnetically engaged with the third magnetic element 33A to further retain the supporting arm 20 end-to-end in a loop structure. As shown in FIG. 6, the fourth magnetic element 34A is located at the peripheral edge 13 of the retention body 10 to align with the second magnetic element 32A along the diameter of the retention body 10, wherein the third magnetic element 33A is provided at the inner surface of the second extension unit 213 to align with the fourth magnetic element 34A when the supporting arm 20 is encircled around the retention body 10.

It is worth to mention that the first and second magnetic elements 31A, 32A are magnetically coupled with each other to ensure the hooking end 212 of the supporting arm 20 being folded to encircle the retention body 10 end-to-end. Since the pivot end 211 of the supporting arm 20 is coupled with the retention body 10 through the sliding shaft 22, the first extension unit 213 of the supporting arm 20 will not be moved at the storage position. Therefore, the fourth magnetic element 34A is provided at the opposed location of the second magnetic element 32A to maximize the magnetically engagement distance of the second and fourth magnetic element 32A, 34A. In other words, the third magnetic element 32A should be provided at the second extension unit 213 to align with the fourth magnetic element 34A. Accordingly, the second and last extension units 213 are magnetically held at the peripheral edge 13 of the retention body 10.

Figure 4:
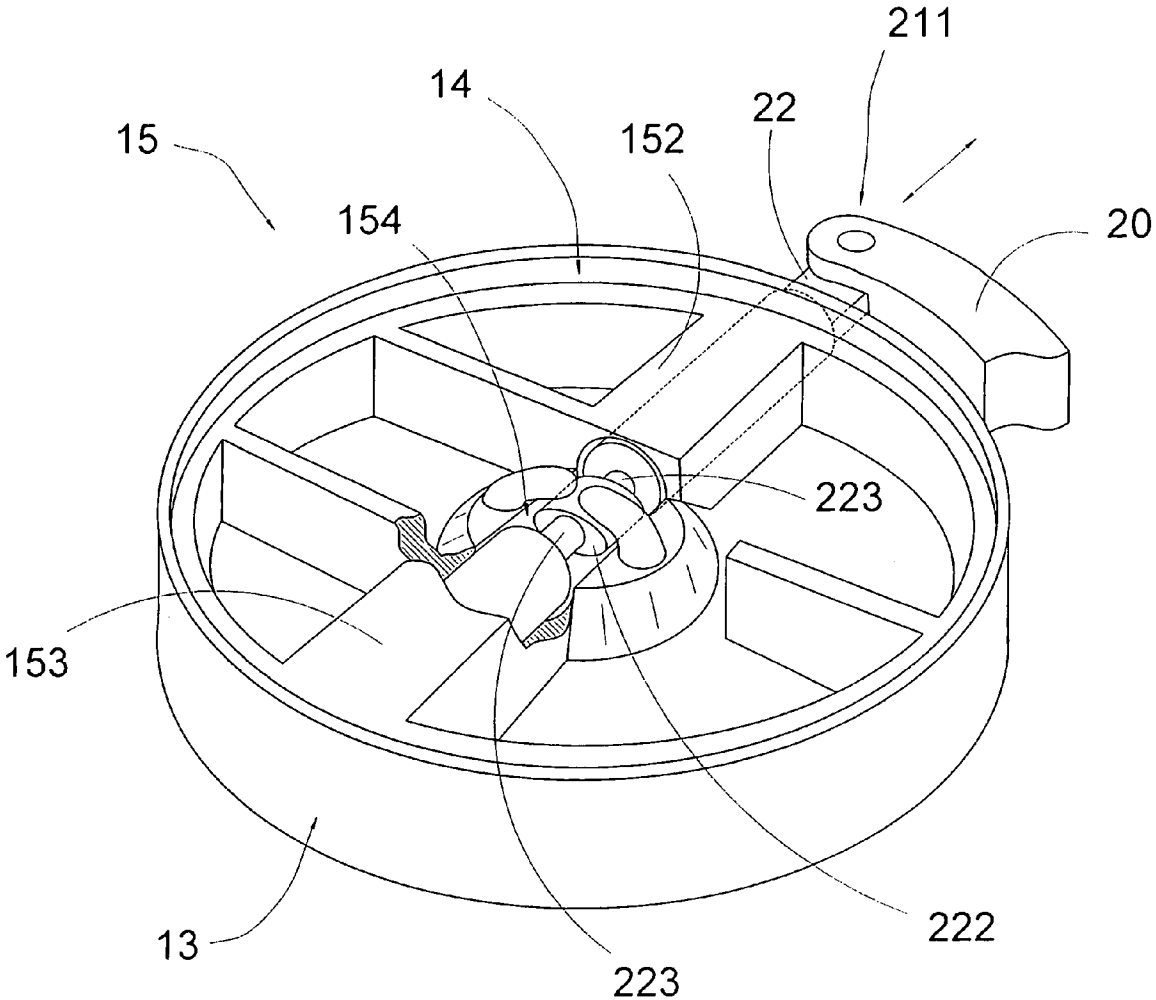
FIG. 4 is a sectional view of the edge swing according to the above preferred embodiment of the present invention.

As shown in FIG. 4, the retention body 10 comprises a slider housing 15 provided in the cavity 14, wherein the slider housing 15 has a slider opening 151 provided at the peripheral edge 13 of the retention body 10. The slider housing 15 further has a first housing 152, a second housing 153 aligned with the first housing 152, and a non-circular slot 154 aligning between the first and second housing 152, 153. It is worth to mention that the non-circular slot 154 is positioned at the center of the retention body 10 to keep the stableness of the retention body 10.

Accordingly, the sliding shaft 22 is slidably engaged between the first and second housing 152, 153 through the non-circular slot 154. In particularly, the sliding shaft 22 has a protruding portion 221 outwardly and slidably protruded from the peripheral edge 13 of the retention body 10 through the slider opening 151 and a guiding portion 222 slidably received in the slider housing 15 to limit a sliding distance of the sliding shaft 22. As shown in FIG. 4, the guiding portion 222 of the sliding shaft 22 is slidably coupled between the first and second housing 152, 153 through the non-circular slot 154. In addition, the sliding shaft 22 further has two narrowing neck portions 223 provided at a position that the guiding portion 222 is formed between the two neck portions 223. The guiding portion 222 of the sliding shaft 22 has a non-circular cross section corresponding to the non-circular slot 154 of the slider housing 15 to define the sliding distance of the sliding shaft 22 between the neck portions 223 thereof, such that the sliding shaft 22 is adapted to be rotated when one of the neck portions 223 of the sliding shaft 22 is slid at the non-circular slot 154.

Accordingly, the distance between the neck portions 223 of the sliding shaft 22 is the sliding distance of the sliding shaft 22. In other words, when the sliding shaft 22 is slid at the storage position, one of the neck portions 223 of the sliding shaft 22 is located within the non-circular slot 154 of the slider housing 15 such that the sliding shaft 22 is adapted to be self-rotated. When the sliding shaft 22 is slid at the hanging position, another neck portion 223 of the sliding shaft 22 is located within the non-circular slot 154 of the slider housing 15 such that the sliding shaft 22 is also adapted to be self-rotated. However, when the guiding portion 222 of the sliding shaft 22 is slid at the non-circular slot 154, the structural configuration of the non-circular slot 154 will block the rotation of the sliding shaft 22. Therefore, the sliding shaft 22 can only be rotated either at the storage position or at the hanging position to ensure the supporting arm 21 being folded between the storage position and the hanging position.

As shown in FIG. 1, the edge swing further comprises a carrying element 40 extended from the hanger unit 20 for detachably attaching to the carrying bag. Accordingly, the carrying element 40 comprises a hanging cable extended from the sliding shaft 22 of the hanger unit 20 for detachably hanging at the carrying bag as an adornment.

In particularly, the carrying element 40 forms a carrying loop for attaching to the strap of the carrying bag, wherein the supporting arm 21 is selectively folded between the storage position and the hanging position while the carrying element 40 is remained attached to the carrying bag so as to always keep the retention body 10 with the carrying bag. In other words, the user does not require detaching the retention body 10 from the carrying bag in order to suspendedly hang the carrying bag at the hooking end 212 of the supporting arm 21. Therefore, the edge swing of the present invention will always attach to the carrying bag with the carrying element 40 so as to prevent the edge swing from being lost accidentally. In order to use the edge swing of the present invention, the user is able to move the retention body 10 to the upper portion of the carrying bag while the carrying element 40 is remained attached to the strap of the carrying bag. Then, by folding the supporting arm 21 at the hanging position, the strap of the carrying bag is hanged at the hooking end 212 of the supporting arm 21 such that the user is able to place the retention body 10 on the top surface of the table to suspendedly hang the carrying bag underneath the table.

The present invention of the edge swing provides a relatively small round personal hanger for carrying bag. It is not only can be a compact size, more portable, easy folded, but also can be used as a decoration. The user is more willing to carry the edge swing everywhere since the edge swing is minimized to a compact size and can be carried as a decoration.

Alternatively, it is worth to mention that the shape of the present invention of the preferred embodiment could be a hexagon, square, or octagon, as long as a retention body of the hanger can distribute the force evenly.

Figure 5:
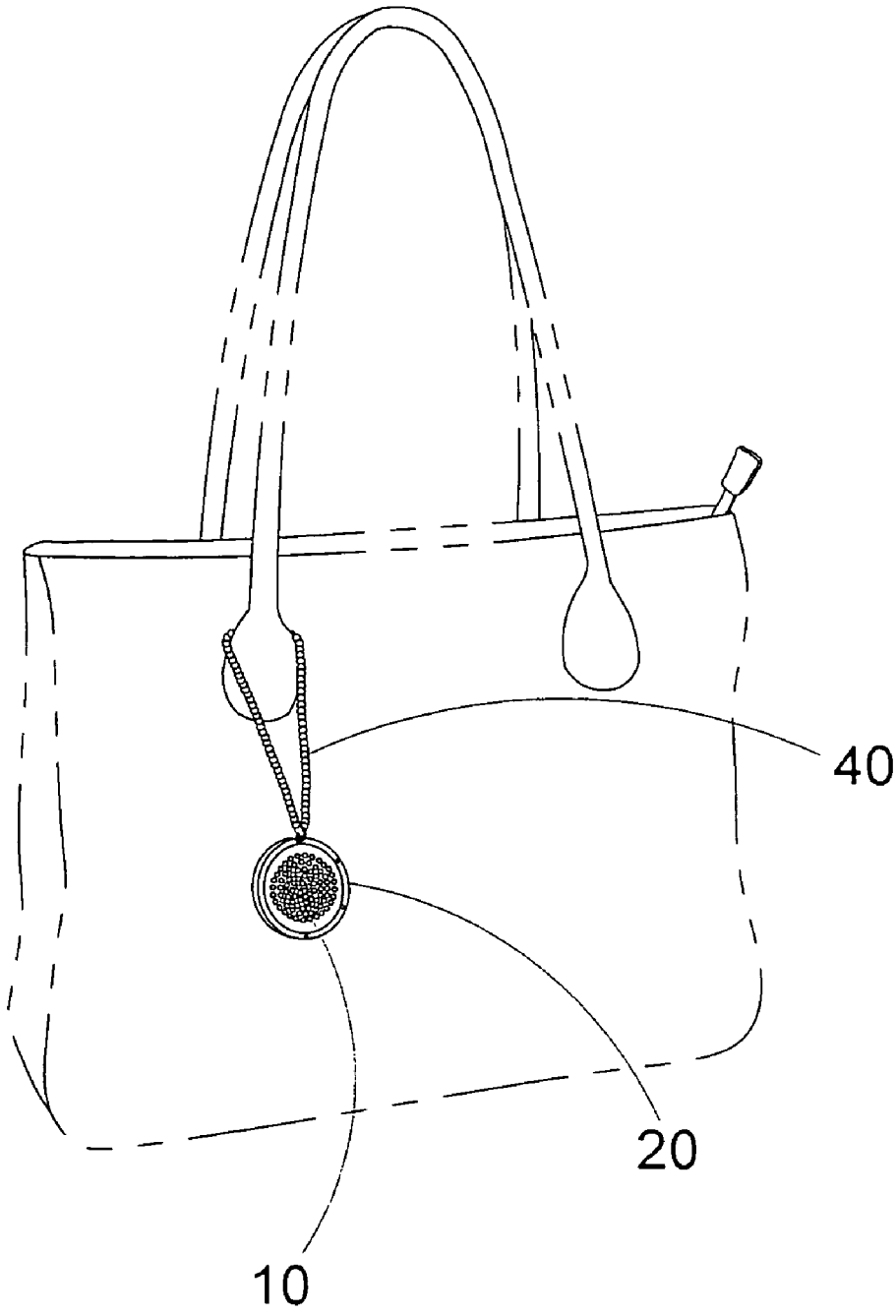
FIG. 5 illustrates the edge swing being carried by the carrying bag according to the above preferred embodiment of the present invention.

According to the present invention of edge swing, the user can carry a portable edge swing anywhere and hang the personal carrying bag underneath the table, as shown in FIG. 5 to have more space on the surface of the table and keep your carrying bag clean and away from the floor.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An edge swing for hanging a carrying bag below a table or the like, comprising:

a retention body having a peripheral edge adapted for being rested on a top surface of said table at a position close to an edge thereof, and comprises a slider housing having a non-circular slot and a slider opening provided at said peripheral edge of said retention body, and a hanger unit comprising:

a sliding shaft slidably and rotatably extended from said peripheral edge of said retention body, wherein said sliding shaft has a free end slidably extended from said peripheral edge of said retention body to adjust a distance between said free end of said sliding shaft and said peripheral edge of said retention body, and a protruding portion outwardly and slidably protruded from said peripheral edge of said retention body through said slider opening, and a guiding portion slidably received in said slider housing to limit a sliding distance of said sliding shaft, wherein said guiding portion of said sliding shaft has a non-circular cross section corresponding to said non-circular slot and forms between two narrowing neck portions of said sliding shaft to define said sliding distance of said sliding shaft between said neck portions thereof, such that said sliding shaft is adapted to be rotated when one of said neck portions of said sliding shaft is slid at said non-circular slot;

a supporting arm, which is adapted to fold between a storage position and a hanging position, having a pivot end pivotally coupling with said free end of said sliding shaft and a hooking end adapted for said carrying bag being hanged thereat, wherein at said storage position, said supporting arm is folded to encircle around said peripheral edge of said retention body to form an outer rim of said retention body, and at said hanging position, said hooking end of said supporting arm is downwardly extended below said table along said edge thereof for suspendedly supporting said carrying bag underneath said table; and a magnetic interlocker provided at said supporting arm to magnetically interlock said supporting arm end-to-end at said storage position in a loop structure.

2. An edge swing for hanging a carrying bag below a table or the like, comprising:

a retention body having a peripheral edge and adapted for being rested on a top surface of said table at a position close to an edge thereof, and comprises a slider housing having a non-circular slot and a slider opening provided at said peripheral edge of said retention body; and a hanger unit comprising:

a sliding shaft slidably and rotatably extended from said peripheral edge of said retention body, wherein said sliding shaft has a free end slidably extended from said peripheral edge of said retention body to adjust a distance between said free end of said sliding shaft and said peripheral edge of said retention body, and a protruding portion outwardly and slidably protruded from said peripheral edge of said retention body through said slider opening and a guiding portion slidably received in said slider housing to limit a sliding distance of said sliding shaft, wherein said guiding portion of said sliding shaft has a non-circular cross section corresponding to said non-circular slot and forms between two narrowing neck portions of said sliding shaft to define said sliding distance of said sliding shaft between said neck portions thereof, such that said sliding shaft is adapted to be rotated when one of said neck portions of said sliding shaft is slid at said non-circular slot;

a supporting arm, which has a predetermined length and is adapted to fold between a storage position and a hanging position, having a pivot end pivotally coupling with said free end of said sliding shaft and a hooking end adapted for said carrying bag being hanged thereat, wherein at said storage position, said supporting arm is folded to encircle around said peripheral edge of said retention body to form an outer rim of said retention body, and at said hanging position, said hooking end of said supporting arm is downwardly extended below said table along said edge thereof for suspendedly supporting said carrying bag underneath said table, wherein said supporting arm comprises a plurality of extension units pivotally coupling with each other end-to-end, wherein each of said extension units has an inner surface having a curvature matching with a peripheral curvature of said retention body in such a manner that said extension units are pivotally folded to alignedly biased against said peripheral edge of said retention body, wherein said predetermined length of said supporting arm corresponds to a circumferential size of said retention arm such that when said supporting arm is folded to encircle said peripheral edge of said retention body at said storage position, said hooking end of said supporting arm is coupled with said pivot end thereof to form a loop structure; and a magnetic interlocker provided at said supporting arm to magnetically interlock said supporting arm end-to-end at said storage position in a loop structure, and comprises a magnetic element provided at said hooking end of said supporting arm, such that when said supporting arm is folded to encircle said peripheral edge of said retention body, said hooking end and said pivot end of said supporting arm are coupled with each other to retain said supporting arm at said storage position in a loop structure, wherein said free end of said sliding shaft is made of magnetic attracting material to magnetically couple with said magnetic element so as to interlock said supporting arm end-to-end at said storage position.

3. An edge swing for hanging a carrying bag below a table or the like, comprising:

a retention body adapted for being rested on a top surface of said table at a position close to an edge thereof, and a hanger unit comprising:

a sliding shaft slidably and rotatably extended from said peripheral edge of said retention body, wherein said sliding shaft has a free end slidably extended from said peripheral edge of said retention body to adjust a distance between said free end of said sliding shaft and said peripheral edge of said retention body;

a supporting arm, which is adapted to fold between a storage position and a hanging position, having a pivot end pivotally coupling with said free end of said sliding shaft and a hooking end adapted for said carrying bag being hanged thereat, wherein at said storage position, said supporting arm is folded to encircle around said peripheral edge of said retention body to form an outer rim of said retention body, and at said hanging position, said hooking end of said supporting arm is downwardly extended below said table along said edge thereof for suspendedly supporting said carrying bag underneath said table;

a magnetic interlocker provided at said supporting arm to magnetically interlock said supporting arm end-to-end at said storage position in a loop structure; and a carrying element extended from said hanger unit for detachably attaching to said carrying bag, wherein said supporting arm is selectively folded between said storage position and said hanging position while said carrying element is remained attached to said carrying bag so as to always keep said retention body with said carrying bag.

4. The edge swing, as recited in claim 3, wherein said supporting arm comprises a plurality of extension units pivotally coupling with each other end-to-end, wherein each of said extension units has an inner surface having a curvature matching with a peripheral curvature of said retention body in such a manner that said extension units are pivotally folded to alignedly biased against said peripheral edge of said retention body.

5. The edge swing, as recited in claim 3, wherein said supporting arm has a predetermined length corresponding to a circumferential size of said retention arm such that when said supporting arm is folded to encircle said peripheral edge of said retention body at said storage position, said hooking end of said supporting arm is coupled with said pivot end thereof to form a loop structure.

6. The edge swing, as recited in claim 4, wherein said supporting arm has a predetermined length corresponding to a circumferential size of said retention arm such that when said supporting arm is folded to encircle said peripheral edge of said retention body at said storage position, said hooking end of said supporting arm is coupled with said pivot end thereof to form a loop structure.

7. The edge swing, as recited in claim 3, wherein said magnetic interlocker comprises a magnetic element provided at said hooking end of said supporting arm, such that when said supporting arm is folded to encircle said peripheral edge of said retention body, said hooking end and said pivot end of said supporting arm are coupled with each other to retain said supporting arm at said storage position in a loop structure.

8. The edge swing, as recited in claim 4, wherein said magnetic interlocker comprises a magnetic element provided at said hooking end of said supporting arm, such that when said supporting arm is folded to encircle said peripheral edge of said retention body, said hooking end and said pivot end of said supporting arm are coupled with each other to retain said supporting arm at said storage position in a loop structure.

9. The edge swing, as recited in claim 6, wherein said magnetic interlocker comprises a magnetic element provided at said hooking end of said supporting arm, such that when said supporting arm is folded to encircle said peripheral edge of said retention body, said hooking end and said pivot end of said supporting arm are coupled with each other to retain said supporting arm at said storage position in a loop structure.

10. The edge swing, as recited in claim 7, wherein said free end of said sliding shaft is made of magnetic attracting material to magnetically couple with said magnetic element so as to interlock said supporting arm end-to-end at said storage position.

11. The edge swing, as recited in claim 8, wherein said free end of said sliding shaft is made of magnetic attracting material to magnetically couple with said magnetic element so as to interlock said supporting arm end-to-end at said storage position.

12. The edge swing, as recited in claim 9, wherein said free end of said sliding shaft is made of magnetic attracting material to magnetically couple with said magnetic element so as to interlock said supporting arm end-to-end at said storage position.

13. The edge swing, as recited in claim 3, wherein said retention body comprises a slider housing having a slider opening provided at said peripheral edge of said retention body, wherein said sliding shaft has a protruding portion outwardly and slidably protruded from said peripheral edge of said retention body through said slider opening and a guiding portion slidably received in said slider housing to limit a sliding distance of said sliding shaft.

14. The edge swing, as recited in claim 12, wherein said retention body comprises a slider housing having a slider opening provided at said peripheral edge of said retention body, wherein said sliding shaft has a protruding portion outwardly and slidably protruded from said peripheral edge of said retention body through said slider opening and a guiding portion slidably received in said slider housing to limit a sliding distance of said sliding shaft.

15. The edge swing, as recited in claim 3, wherein said retention body, having a circular cross section, has a top decorative side and a bottom friction side adapted for resting on said top surface of said table to stably support said carrying bag underneath said table.

16. The edge swing, as recited in claim 14, wherein said retention body, having a circular cross section, has a top decorative side and a bottom friction side adapted for resting on said top surface of said table to stably support said carrying bag underneath said table.

* * * * *